United States Patent [19]

Theis et al.

[11] 4,222,257

[45] Sep. 16, 1980

[54] METHOD OF MANUFACTURING ROLLED WIRE ROD

[75] Inventors: Klaus Theis, Hamburg; Eckehard Förster, Seevetal; Wolfram Becher, Neümunster, all of Fed. Rep. of Germany; Hans-Jörg Töpfer, deceased, late of Buxtehude, Fed. Rep. of Germany, by Marion Töpfer, heiress

[73] Assignee: Hamburger Stahlwerke GmbH, Hamburg, Fed. Rep. of Germany

[21] Appl. No.: 848,911

[22] Filed: Nov. 7, 1977

[30] Foreign Application Priority Data

Apr. 21, 1977 [DE] Fed. Rep. of Germany ..... 2717780

[51] Int. Cl.[3] ..... B21B 45/02; C21D 8/06; C21D 9/52

[52] U.S. Cl. ..... 72/201; 72/700; 148/12 B

[58] Field of Search ..... 72/201, 364, 365, 700; 148/12 B, 12.4, 156

[56] References Cited

U.S. PATENT DOCUMENTS

| | | | |
|---|---|---|---|
| 3,231,432 | 1/1966 | McLean et al. | 148/12 B |
| 3,666,572 | 5/1972 | Nakagawa et al. | 148/12 B |
| 3,874,950 | 4/1975 | Grozier et al. | 148/156 X |
| 3,881,337 | 5/1975 | Cofer et al. | 72/201 X |
| 3,930,900 | 1/1976 | Wilson | 148/12 B |
| 3,939,015 | 2/1976 | Grange | 148/12 B |
| 3,940,294 | 2/1976 | Sergeant | 148/12 B |
| 4,016,009 | 4/1977 | Economopoulos et al. | 148/12 B |
| 4,046,599 | 9/1977 | Economopoulos | 148/12 B |
| 4,060,428 | 11/1977 | Wilson | 72/201 X |

*Primary Examiner*—Ervin M. Combs

[57] ABSTRACT

A method and apparatus of manufacturing wire rod having a content of silicon and manganese greater than 1.5% is described, wherein the average final rolling temperature in processing the rod is from 870° C. to 970° C. and the rod is cooled in an extended position. The composition of steels utilized in the method is also described.

9 Claims, 2 Drawing Figures

METHOD OF MANUFACTURING ROLLED WIRE ROD

BACKGROUND

Figure 1:
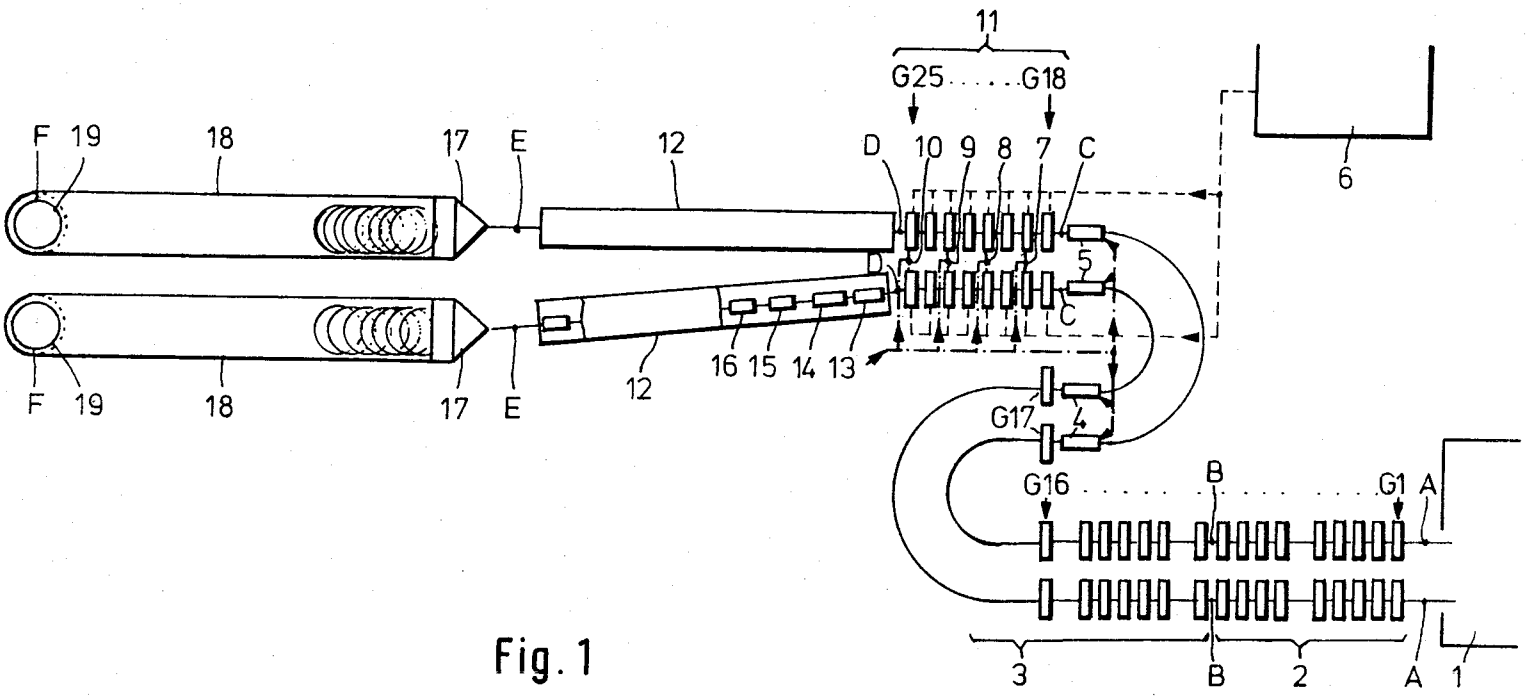

The invention relates to a method of manufacturing rolled wire rod having a combined silicon and manganese content greater than one and a half percent.

Steels of relatively high manganese and silicon contents are difficult to roll on modern high-speed wire rod rolling mills. This is especially the case when these mills are equipped with a modern wire rod adjuster for the accelerated cooling of the wire rod after rolling. Such a wire adjuster is, for example, a unit on which the wire rod is spread out in loops to cool down uniformly after rolling. The cause of the difficulty is the occurrence of brittle structural components consisting of martensite or bainite which seriously impair the drawing quality of wire rod. By the term, "steels of relatively high manganese and silicon content," as used herein, are meant steels in which the sum of the manganese and silicon contents amount to more than one and a half percent. The occurrence of the brittle structural components is also promoted by alloying components such as chromium and molybdenum. In steels which contain chromium and molybdenum, the above-given definition must be extended to the effect that the sum of manganese+silicon+chromium+molybdenum amounts to more than 1.5%. One especially important representative of these steels is what are known as $CO_2$ welding rods, which are used for welding under carbon dioxide shielding gas. Their analysis commonly ranges from 0.80 to 1% silicon, 1.30 to 1.80% manganese, and 0.07 to 0.14% carbon. The composition of other steels in which difficulty is caused by the occurrence of brittle structural components is illustrated in the following Tables I to IV.

TABLE I

| | |
|---|---|
| 0.05–0.20% | carbon |
| 0.50–1.50% | silicon |
| 0.80–3.00% | manganese |
| 0 –1.2% | chromium |
| 0 –0.30% | titanium |
| 0 –0.30% | zirconium |
| 0 –0.60% | molybdenum |
| 0 –0.40% | vanadium |
| 0 –0.50% | copper |
| 0 –1.50% | nickel |
| 0 –0.10% | aluminum |
| 0 –0.020% | nitrogen |
| 0 –0.040% | sulfur |
| 0 –0.040% | phosphorous |

Remainder iron+common impurities, the sum of the contents of silicon, manganese, chromium and molybdenum amounting to more than 1.5%.

TABLE II

| | |
|---|---|
| 0.05–0.20% | carbon |
| 0.50–1.50% | silicon |
| 0.80–3.00% | manganese |
| 0 –0.25% | chromium |
| 0 –0.01% | titanium |
| 0 –0.05% | molybdenum |
| 0 –0.05% | vanadium |
| 0 –0.35% | copper |
| 0 –0.25% | nickel |
| 0 –0.02% | aluminium |
| 0 –0.015% | nitrogen |
| 0 –0.040% | sulfur |

TABLE II-continued

| | |
|---|---|
| 0 –0.040% | phosphorous |

remainder iron+common impurities, the sum of the contents of silicon, manganese, chromium and molybdenum amounting to more than 1.5%.

TABLE III

| | |
|---|---|
| 0.05–0.20% | carbon |
| 0.70–1.20% | silicon |
| 0.80–2.00% | manganese |
| 0 –0.15% | chromium |
| 0 –0.01% | titanium |
| 0 –0.05% | molybdenum |
| 0 –0.05% | vanadium |
| 0 –0.35% | copper |
| 0 –0.25% | nickel |
| 0 –0.02% | aluminium |
| 0 –0.015% | nitrogen |
| 0 –0.040% | sulfur |
| 0 –0.040% | phosphorous |

remainder iron+common impurities, the sum of the contents of silicon, manganese, chromium and molybdenum amounting to more than 1.5%.

TABLE IV

| | |
|---|---|
| 0.06–0.14% | carbon |
| 0.70–1.00% | silicon |
| 1.30–1.60% | manganese |
| 0 –0.15% | chromium |
| 0 –0.01% | titanium |
| 0 –0.05% | molybdenum |
| 0 –0.05% | vanadium |
| 0 –0.20% | copper |
| 0 –0.15% | nickel |
| 0 –0.02% | aluminium |
| 0 –0.015% | nitrogen |
| 0 –0.040% | sulfur |
| 0 –0.040% | phosphorous |

balance iron+common impurities, the sum of the contents of silicon, manganese, chromium and molybdenum amounting to more than 1.5%.

It is known that in the foregoing steels the occurrence of brittle structural components is avoided if the rod cools very slowly after rolling. $CO_2$ welding rod is consequently produced preferably on wire rod rolling mills in which a coil of wire rod weighing from 0.3 to 1 metric ton is wound on Edenborn reels at temperatures of around 800° C. after rolling. The cooling down from this temperature takes place in these coils with extreme slowness, with the result that the formation of brittle structural components is prevented. Cooling in the coil, however, brings it about that the outer portions of the wire cool more rapidly than the inner portions. The quality of the wire rod cooled in the coil is therefore very irregular in comparison with the product of modern wire rod adjusters. This wire rod consequently does not have good drawing qualities.

A product of very good drawing qualities is produced when the rod is subjected to another annealing followed by very slow cooling. This annealing, however, involves considerably additional cost.

THE INVENTION

The invention sets for itself the task of solving the problem of producing, on rolling mills equipped with modern wire adjusters, rolled wire rod of good drawing qualities having high silicon and manganese contents as defined above, especially of producing $CO_2$ welding rod and of wire containing alloy components which promote the formation of brittle structural components. The term, "modern wire adjusters," as used herein, refers to those which cool the wire after rolling, while it is spread out or fanned out in standing or laying loops, and, after it has been cooled down to, say, 300° C. to 600° C., gather it into a coil (cf. German Offenlegungschrift No. 1,608,387 and German Auslegeschrift No. 1,752,519).

The method of the invention which leads to the desired result is characterized by the fact that the rolling in the final stands—the "finishing mill," as they are called collectively—is performed at a relatively low temperature with an end roll temperature of 870° C. to 970° C., and that the wire is then cooled down in the outspread state, at an average cooling rate of less than 8° C. per second, to a temperature of about 300° C. to 600° C., at which the outspread loops are gathered into a coil.

It has been found to be especially advantageous, and to further improve the drawing quality of the wire rod, if, after the rolling in the finishing mill at temperatures ranging from 870° C. to 970° C., the wire rod is cooled very quickly, i.e., in less than 0.7 second, with water, and after this cooling the further cooling of the wire in the outspread state, down to about 400° C. to 600° C., takes place at a rate averaging less than 8° C. per second.

Additional features of the invention will be set forth in the subordinate claims.

As it is known, wire rod is commonly rolled at temperatures which are much higher than the $Ac_3$ point, and at which the iron is consequently present as austenite. The formation of the brittle structural components, martensite or bainite, takes place when the austenite is cooled to the temperature of the formation of martensite or of bainite, without the occurrence beforehand of a breakdown of the austenite to the pearlite structure which is desired for drawing, which consists of the components ferrite and cementite.

The invention is based upon the knowledge that wire rod which has been rolled from billets heated in the pusher furnace at 1100° C. to 1300° C. in a modern high-speed wire rod rolling mill at rolling speeds of more than 40 meters per second and temperatures of over 1000° in the finishing mill, especially in the case of high manganese and silicon contents, has a delayed breakdown of the austenite to ferrite and cementite. The result of this delayed transformation is that, in the case of the cooling rates of the outspread wire in modern wire rod adjusters, of about 3° to 10° C. per second, the breakdown of the austenite is delayed to such an extent that the formation of martensite or bainite occurs locally. The cause of this effect is evidently that, when the steel is heated in the pusher furnace, fine segregations, such as aluminum nitrides, for example, which as foreign bodies make it possible to break down the austenite by heterogeneous nucleation, are dissolved. The more rapidly the rolling takes place, the higher, automatically, is the rolling temperature, because, as the rolling speed increases, the rod is given ever less opportunity to cool during the rolling. The result is that lattice dislocations which are caused by the destruction of the structure during the rolling, are immediately healed up and can no longer be trouble points leading to a rapid breakdown of the austenite by heterogeneous nucleation. The consequence is a tendency of the material thus rolled to form brittle structural components upon cooling, if its analysis permits it. Ordinarily, this effect is counteracted by performing the cooling after the rolling at an extremely slow rate, so that the austenite will break down in the desired manner into ferrite and cementite, despite the great lack of the possibility to break down on the basis of heterogeneous nucleation. In contrast to this conventional method of procedure, the invention takes the course of performing the rolling itself at such a low temperature that the lattice dislocations produced in the rolling do not heal up completely at once, but remain in a sufficient concentration to accelerate the transformation of the austenite as dislocations for heterogeneous nucleation. This effect is intensified if immediately after the rolling the rod is cooled very rapidly to a temperature of 700° C. to 850° C., preferably 740° C. to 800° C. By the freezing of the lattice dislocations produced in the rolling, thus preventing them from healing, the concentration of the lattice dislocations for the subsequent breakdown of the austenite is considerably increased, with the consequence that the transformation of austenite to ferrite and cementite is accelerated, and the formation of the hardness structure is further suppressed. It is especially advantageous in this case if the jets for the water cooling of the wire rod after rolling are set up at a very short distance behind the last rolling stand, so that the further cooling commences less than 0.08 second after the rolling.

It has proven to be advantageous to bring about the lowering of the rolling temperature by having the wire pass, before entering into the finishing mill, through one or more water cooling tubes, which can best be operated countercurrently. Furthermore, it is desirable to provide water cooling nozzles between the individual stands of the finishing mill and operate them countercurrently also. The two cooling operations produce individually or together, even at rolling speeds of more than 40 meters per second, a lowering of the rolling temperature of the wire to temperatures of 870° C. to 970° C. at the point of emergence from the final stand. After the rolling it is desirable to cool the rod with water, in a known manner, in a series of concurrent-flow cooling tubes, to 700° C. to 850° C., preferably 740° C. to 800° C.

The wire rod thus produced is distinguished by an especially fine-grained structure. The ASTM grain size is 8 and higher in the vicinity of the surface, and can increase to 6 towards the center.

Figure 2:
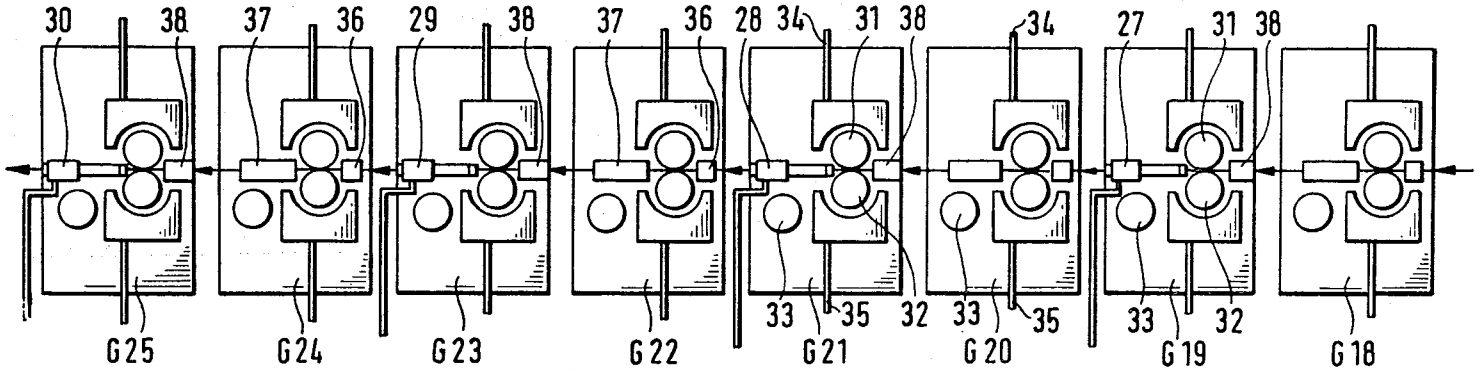

The method of the invention will be further explained with the aid of an example of its embodiment represented with the aid of two figures in the appended drawings, wherein FIG. 1 is a diagrammatic top plan view of an apparatus for the practice of the method of the invention; FIG. 2 is a side view of the finishing mill of said apparatus.

In the two-strand wire rod rolling mill represented in the drawing, billets heated in a pusher furnace 1 and having the composition 0.08% carbon, 0.90% silicon, 1.50% manganese, 0.05% chromium, 0.1% copper, 0.005% aluminum, are rolled to form $CO_2$ welding rod of 5.5 mm diameter. The two-strand rolling mill has twenty-five rolling stands G-1 to G-25, nine of which constitute what is known as the roughing mill 2, eight constitute the intermediate mill 3, and eight constitute the finishing mill 11. The average temperature of the metal after heating in the pusher furnace 1 was 1150° C. (measuring point A) and 950° C. behind the roughing mill 2 (measuring point B). It was reduced to 900° C. by water cooling sections 4 and 5 after emerging from the intermediate mill 3 (measuring point C). The wire rod entered the finishing mill at this temperature. In the finishing mill, countercurrent water cooling nozzles 27,28 and 29 (See FIG. 2) were disposed between stands G19 and G 20, between G 21 and G 22, and between G 23 and G 24, which were fed with cooling water from supply pipes 7,8 and 9. The temperature of the rod upon emerging from the final stand G 25 of the finishing mill 11 was 910° C. (measuring point D). An additional countercurrent water cooling nozzle 30 (See FIG. 2) fed with cooling water from a supply pipe 10, can be provided just behind the final stand G 25. The rolling speed after the last stand amounted to 50 meters per second. The wire rod was cooled behind the final rolling stand in four cooling tubes 13 to 16 of a water cooling section 12, to a temperature of 770° C., which is the average temperature over the cross section (at measuring point E). After this cooling, the rod was laid on a conveyor 18 in loops by means of a loop layer 17. The distance between the loops was 2 cm. In this manner a cooling rate of an average of 3° C. per second was established. The rod was cooled on this conveyor to about 400° C. (measuring point F), and was gathered at this temperature into coils in the coil former 19. The cooling in the coil took place substantially more slowly. A structural study of this wire revealed a ferritic-pearlitic structure with minor amounts of brittle structural components. The wire was drawn in a wire drawing machine of 11 drawing stages to a diameter of 1.0 mm, without any difficulty. In the repetitive flexing test of DIN 51211, this wire could be bent twelve times before breaking. As an alternative, a quantity of 5 metric tons of the same material was rolled with the same temperature program, but after the rolling it was not further cooled with water; instead, it was laid down in loops on the conveyor at the rolling temperature of 910° C. This material had somewhat more brittle structural components. It was likewise drawn to a diameter of 1 mm on a drawing machine in 11 drawing stages. A number of wire breakages occurred in the drawing of this material. The plastic deformability of this material was poorer. In the bending test of DIN 51211, this material was able to be flexed nine times before breaking.

The prescribed temperature levels can be measured by means of thermochrome crayons. The average temperature can be calculated from the determined surface temperature if there is any substantial difference between the core and the surface. The low cooling rate in the outspread wire rod loops can be brought about by providing shielding beneath the conveyor by means of plates. The cooling conditions can be controlled by the spacing of the loops. The term, "wire rod in the outspread state," as used herein, is to be understood to mean wire rod lying flat in fanned or shingled loops or wire rod in standing loops that are drawn apart. These types of outspread loops are represented, for example, in German Offenlegungsschrift No. 1,608,387 and in German Auslegeschrift No. 1,752,519. FIG. 2 shows the finishing mill 11 of one of the two strands of the two-strand rolling mill on a larger scale. Each of the stands G 18 to G 25 comprises two rolls 31 and 32 the wire being passed through the both rollsand being rolled. The rolls are driven by a driving shaft 33. In order to cool the rolls cooling water 13 supplied from a cooling tower 6 (see broken line in FIG. 1). Each of the stands G19, G21 and G23 respectively is provided with a countercurrent water cooling nozzle 27, to 28 and 29 respectively fed with cooling water from supply piper 7, 8 and 9, respectively represented in FIG. 1 by broken lines. Further the last stand G25 is provided with a countercurrent water cooling nozzle 30 at its end, fed with cooling water from a supply pipe 10 (see FIG. 1).

The stands G 18, G20, G22 and G24 have at their inputs static inlet guides 36 for the wire and at their outputs twisters 37 twisting the wire by 90°. Each of the stands G19, G21, G23 and G25 respectively is provided with a roller box.

We claim:

1. A method of manufacturing rolled wire rod, wherein a steel is rolled into a rod at an elevated temperature comprising controlling the average temperature at the time of final rolling at from about 870° to 970° C., then cooling the same very rapidly with water to about 700° to 850° C., and further cooling the same in an outspread state, the composition of the steel being as follows:

| | |
|---|---|
| 0.05 to 0.20% | carbon |
| 0.50 to 1.50% | silicon |
| 0.80 to 3.00% | manganese |
| 0 to 1.2% | chromium |
| 0 to 0.30% | titanium |
| 0 to 0.30% | zirconium |
| 0 to 0.60% | molybdenum |
| 0 to 0.40% | vanadium |
| 0 to 0.50% | copper |
| 0 to 1.50% | nickel |
| 0 to 0.10% | aluminum |
| 0 to 0.020% | nitrogen |
| 0 to 0.040% | sulfur |
| 0 to 0.040% | phosphorus |

balance iron and common impurities, the sum of the contents of silicon, manganese, chromium and molybdenum amounting to more than 1.5%.

2. A method in accordance with claim 1, wherein cooling in the outspread state takes place slowly at an average cooling rate of less than 8° C./second.

3. A method in accordance with claim 1, wherein the wire is cooled in the outspread state to about 300° to 600° C., and further cooling takes place after the outspread coils of wire have been gathered into a bundle.

4. A method in accordance with claim 1, wherein the wire is chilled very rapidly to 740° to 800° C., immediately after the rolling operation.

5. A method in accordance with claim 1, wherein the composition of the steel is as follows:

| | |
|---|---|
| 0.05–0.20% | Carbon |
| 0.50–1.50% | Silicon |
| 0.80–3.00% | Manganese |
| 0–1.2% | chromium |
| 0–0.30% | titanium |
| 0.–0.30% | zirconium |
| 0–0.60% | molybdenum |
| 0–0.40% | vanadium |
| 0–0.50% | copper |
| 0–1.50% | nickel |
| 0–0.10% | aluminum |
| 0–0.020% | nitrogen |
| 0–0.040% | sulfur |
| 0–0.040% | phosphorus |

remainder iron plus common impurities, the sum of the contents of silicon, manganese, chromium and molybdenum amounting to more than 1.5%.

6. A method in accordance with claim 1, wherein the composition of the steel is as follows:

| | |
|---|---|
| 0.05–0.20% | carbon |
| 0.05–1.50% | silicon |
| 0.80–3.00% | manganese |
| 0–0.25% | chromium |
| 0–0.01% | titanium |
| 0–0.05% | molybdenum |
| 0–0.05% | vanadium |
| 0–0.35% | copper |
| 0–0.25% | nickel |
| 0–0.02% | aluminum |
| 0–0.015% | nitrogen |
| 0–0.040% | sulfur |
| 0–0.040% | phosphorus |

remainder iron plus common impurities, the sum of the contents of silicon, manganese, chromium and molybdenum amounting to more than 1.5%.

7. A method in accordance with claim 1, wherein the composition of the steel is as follows:

| | |
|---|---|
| 0.05–0.20% | carbon |
| 0.70–1.20% | silicon |
| 0.80–2.00% | manganese |
| 0 –0.15% | chromium |
| 0 –0.01% | titanium |
| 0 –0.05% | molybdenum |
| 0 –0.05% | vanadium |
| 0 –0.35% | copper |
| 0 –0.25% | nickel |
| 0 –0.02% | aluminum |

-continued

| | |
|---|---|
| 0 –0.015% | nitrogen |
| 0 –0.040% | sulfur |
| 0 –0.040% | phosphorous |

remainder iron plus common impurities, the sum of the contents of silicon, manganese, chromium and molybdenum amounting to more than 0.5%.

8. A method in accordance with claim 1, wherein the composition of the steel is as follows:

| | |
|---|---|
| 0.06–0.14% | carbon |
| 0.70–1.00% | silicon |
| 1.30–1.60% | manganese |
| 0 –0.15% | chromium |
| 0 –0.01% | titanium |
| 0 –0.05% | molybdenum |
| 0 –0.05% | vanadium |
| 0 –0.20% | copper |
| 0 –0.15% | nickel |
| 0 –0.02% | aluminum |
| 0 –0.015% | nitrogen |
| 0 –0.040% | sulfur |
| 0 –0.040% | phosphorous |

remainder iron plus common impurities, the sum of the contents of silicon, manganese, chromium and molybdenum amounting to more than 1.5%.

9. A method in accordance with claim 1, wherein the steel has a silicon-plus-manganese content greater than 1.5%.

* * * * *